US009193365B2

(12) United States Patent
Ogawa et al.

(10) Patent No.: US 9,193,365 B2
(45) Date of Patent: Nov. 24, 2015

(54) RAILCAR DAMPING DEVICE

(75) Inventors: Takayuki Ogawa, Sagamihara (JP); Jun Aoki, Sagamihara (JP); Masaru Uchida, Sagamihara (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 69 days.

(21) Appl. No.: 14/127,921

(22) PCT Filed: Jun. 19, 2012

(86) PCT No.: PCT/JP2012/065606

§ 371 (c)(1),
(2), (4) Date: Dec. 19, 2013

(87) PCT Pub. No.: WO2012/176761

PCT Pub. Date: Dec. 27, 2012

(65) Prior Publication Data

US 2014/0116826 A1 May 1, 2014

(30) Foreign Application Priority Data

Jun. 20, 2011 (JP) ..... 2011-136163

(51) Int. Cl.
*B61F 5/24* (2006.01)

(52) U.S. Cl.
CPC ..... *B61F 5/245* (2013.01)

(58) Field of Classification Search
CPC ..... B61F 5/00; B61F 5/02; B61F 5/04; B61F 5/10; B61F 5/12; B61F 5/127; B61F 5/38; B61F 5/386
USPC ..... 105/157.1, 164, 171, 176, 194, 105/198.1–198.3, 209, 453
See application file for complete search history.

(56) References Cited

U.S. PATENT DOCUMENTS

| | | | | |
|---|---|---|---|---|
| 3,854,420 | A * | 12/1974 | Hinnen et al. | 105/176 |
| 7,688,218 | B2 * | 3/2010 | LeFebvre et al. | 340/682 |
| 2011/0192157 | A1 | 8/2011 | Ogawa | |

FOREIGN PATENT DOCUMENTS

| | | | |
|---|---|---|---|
| GB | 2414816 | A | 12/2005 |
| JP | H11-139310 | A | 5/1999 |
| JP | 2003-320931 | A | 11/2003 |
| JP | 2005-030559 | A | 2/2005 |
| JP | 2006-327529 | A | 12/2006 |
| JP | 2008-247204 | A | 10/2008 |
| JP | 2008-247333 | A | 10/2008 |
| JP | 2010-065797 | A | 3/2010 |

OTHER PUBLICATIONS

Extended European Search Report dated Mar. 11, 2015.

* cited by examiner

*Primary Examiner* — R. J. McCarry, Jr.
(74) *Attorney, Agent, or Firm* — Rabin & Berdo, P.C.

(57) ABSTRACT

A railcar damping device includes: a tank storing a liquid; a first opening/closing valve provided in a first passage connecting a rod side chamber to a piston side chamber, which are defined by a piston, to be capable of opening and closing the first passage; a second opening/closing valve provided in a second passage connecting the piston side chamber to the tank to be capable of opening and closing the second passage; a pump that supplies the liquid from the tank to the rod side chamber; a motor that rotates at a fixed rotation speed in order to drive the pump to rotate; and a section determination unit that determines whether a section type of a current travel section of the railcar is an open section or a tunnel section on the basis of a speed deviation between a target rotation speed and an actual rotation speed of the motor.

10 Claims, 5 Drawing Sheets

RAILCAR DAMPING DEVICE

TECHNICAL FIELD

This invention relates to an improvement in a railcar damping device.

BACKGROUND ART

A known example of a conventional railcar damping device is interposed between a vehicle body and a truck of a railcar and used to suppress left-right direction vibration relative to an advancement direction.

JP2010-65797A discloses a railcar damping device including: a cylinder coupled to either a truck or a vehicle body of a railcar; a piston inserted into the cylinder to be free to slide; a rod inserted into the cylinder and coupled to the other of the truck and the vehicle body and to the piston; a rod side chamber and a piston side chamber defined within the cylinder by the piston; a tank storing a liquid that is supplied to the cylinder; a first opening/closing valve provided midway in a first passage that connects the rod side chamber to the piston side chamber; a second opening/closing valve provided midway in a second passage that connects the piston side chamber to the tank; a pump that supplies working oil to the rod side chamber; an exhaust passage that connects the rod side chamber to the tank; and a variable relief valve that is provided midway in the exhaust passage and has a modifiable valve opening pressure. By driving the pump, the first opening/closing valve, the second opening/closing valve, and the variable relief valve, an actuator can generate thrust in both an expansion direction and a contraction direction, and vibration of the vehicle body is suppressed by this thrust.

SUMMARY OF INVENTION

In this railcar damping device, the thrust to be generated by the actuator is determined as a thrust command value, and the vibration of the vehicle body is suppressed by controlling the thrust of the actuator in accordance with the thrust command value.

The thrust command value is calculated using a control gain or the like. When skyhook control is performed, for example, the thrust command value is calculated by multiplying a skyhook gain serving as the control gain by a lateral direction speed of the vehicle body. Hence, the thrust command value is determined by detecting an element such as an acceleration or a speed, and multiplying this element by the control gain.

In most cases, a railcar must travel along a route including both open sections, i.e. non-tunnel sections, and tunnel sections during a single commercial journey. A vibration mode of the vehicle body differs between the open section and the tunnel section. During a single commercial journey, therefore, the railcar must travel through sections having different vibration modes. The vibration mode of the vehicle body also differs within an open section between a straight section and a curved section.

Hence, when the actuator is controlled by calculating the thrust command value using a fixed control gain, the thrust command value may not be appropriate for the vibration mode, and as a result, it may be impossible to suppress the vibration of the vehicle body effectively, meaning that favorable passenger comfort cannot be maintained. In a conventional railcar damping device, therefore, information indicating a travel position of the railcar and information indicating a section type of a current travel section is obtained from a vehicle monitoring device or the like of the railcar. An optimum control gain is then selected by referring to a table on which the obtained information is associated with a control gain.

To obtain the information indicating the section type of the current travel section and the travel position of the railcar from a vehicle monitoring device or the like in this manner, an interface that connects the railcar damping device to the vehicle monitoring device is required. Further, in a railcar not having a developed vehicle information transmission facility, such as a railcar used on a narrow gauge railway, the above information cannot be obtained, and the railcar damping device cannot be installed easily.

This invention has been designed in consideration of the problems described above, and an object thereof is to provide a railcar damping device that can determine a section type of a current travel section of a railcar without obtaining information indicating a travel position and the section type of the current travel section from a vehicle monitoring device.

According to one aspect of this invention, a railcar damping device that determines a thrust to be output by an actuator as a thrust command value, and suppresses vibration of a vehicle body by controlling the actuator is provided. The actuator includes: a cylinder coupled to one of a truck and a vehicle body of a railcar; a piston inserted into the cylinder to be free to slide; a rod inserted into the cylinder and coupled to the piston and the other of the truck and the vehicle body; and a rod side chamber and a piston side chamber defined within the cylinder by the piston. The railcar damping device includes: a tank that is configured to store a liquid that is supplied to and discharged from the cylinder; a first opening/closing valve provided in a first passage connecting the rod side chamber to the piston side chamber to be capable of opening and closing the first passage; a second opening/closing valve provided in a second passage connecting the piston side chamber to the tank to be capable of opening and closing the second passage; a pump that is configured to supply the liquid from the tank to the rod side chamber; a motor that is configured to rotate at a fixed rotation speed in order to drive the pump to rotate; and a section determination unit that is configured to determine whether a section type of a current travel section of the railcar is an open section or a tunnel section on the basis of a speed deviation between a target rotation speed and an actual rotation speed of the motor.

The details as well as other features and advantages of this invention are set forth in the remainder of the specification and are shown in the accompanying drawings.

DESCRIPTION OF EMBODIMENTS

Referring to the figures, a railcar damping device 1 according to an embodiment of this invention will be described below.

Figure 1:
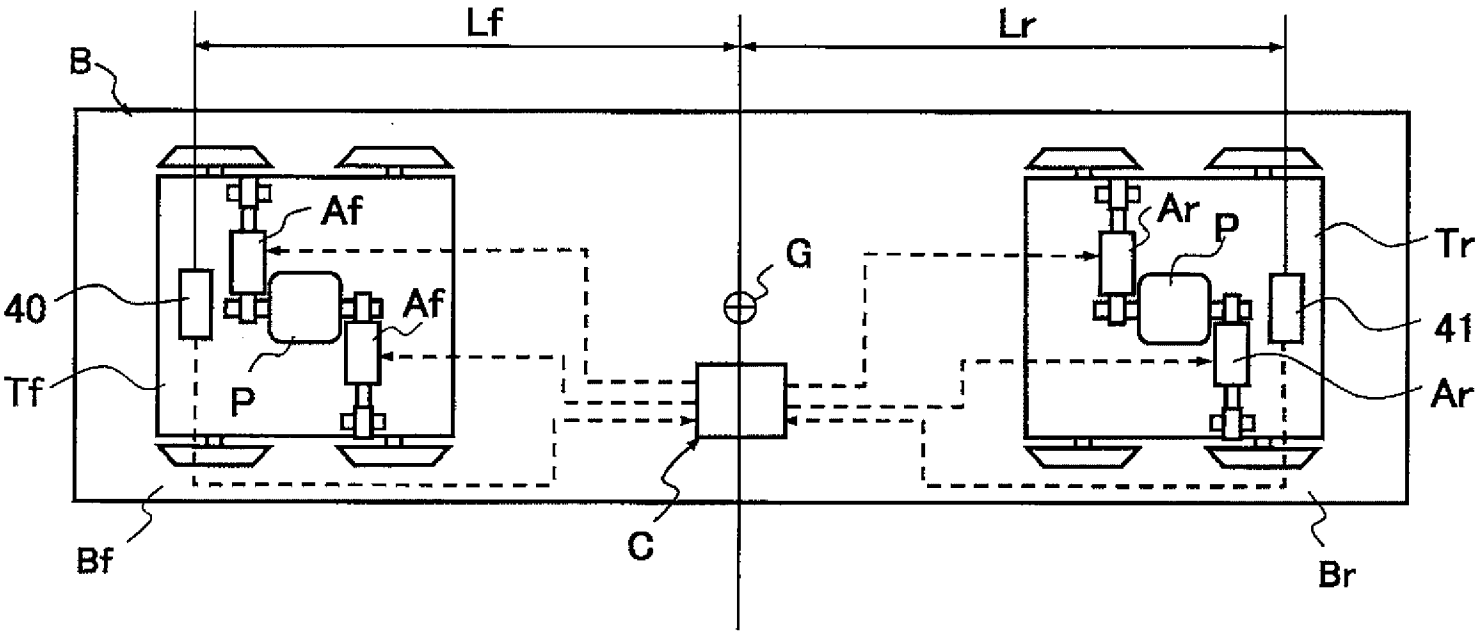
FIG. 1 is a plan view showing a configuration of a railcar installed with a railcar damping device according to an embodiment of this invention.

The railcar damping device 1 is used as a damping device for a vehicle body B of a railcar. As shown in FIG. 1, the railcar damping device 1 includes a front side actuator Af interposed between a front side truck Tf and the vehicle body B, a rear side actuator Ar interposed between a rear side truck Tr and the vehicle body B, and a controller C that actively controls the two actuators Af, Ar. The railcar damping device 1 determines a thrust to be output by the actuators Af, Ar as a thrust command value, and controls the actuators Af, Ar to suppress vibration of the vehicle body B.

The actuator Af and the actuator Ar are respectively provided in pairs. The front and rear actuators Af, Ar are coupled to pins P suspended downward from the vehicle body B of the railcar so as to be interposed in respective parallel pairs between the vehicle body B and the front and rear trucks Tf, Tr.

Basically, the front and rear actuators Af, Ar are actively controlled to suppress vibration in a horizontal lateral direction relative to a vehicle advancement direction of the vehicle body B. In this case, the controller C performs active control to control the front and rear actuators Af, Ar such that vibration in a lateral direction of the vehicle body B is suppressed.

More specifically, when performing control to suppress vibration of the vehicle body B, the controller C detects a lateral direction acceleration $\alpha f$ of a front portion Bf of the vehicle body B in a horizontal lateral direction relative to the vehicle advancement direction and a lateral direction acceleration $\alpha r$ of a rear portion Br of the vehicle body B in a horizontal lateral direction relative to the vehicle advancement direction. The controller C then calculates a yaw acceleration $\omega$, which is an angular acceleration about a vehicle body center G directly above the front and rear trucks Tf, Tf, on the basis of the detected lateral direction acceleration $\alpha f$ and lateral direction acceleration $\alpha r$. The controller C also calculates a sway acceleration $\beta$, which is an acceleration in a horizontal lateral direction of the vehicle body center G, on the basis of the detected lateral direction acceleration $\alpha f$ and lateral direction acceleration $\alpha r$. The controller C then calculates thrust command values Ff, Fr, which are values of the thrust to be generated individually by the front and rear actuators Af, Ar, on the basis of the calculated yaw acceleration $\omega$ and sway acceleration $\beta$. The controller C then performs feedback control such that thrust corresponding to the thrust command values Ff, Fr is generated by the front and rear actuators Af, Ar, and in so doing suppresses vibration in the lateral direction of the vehicle body B.

In FIG. 1, two each of the actuator Af and the actuator Ar are provided, and the actuators Af, Ar are controlled by the single controller C. Instead, however, one controller C may be provided for each of the actuators Af, Ar.

Figure 2:
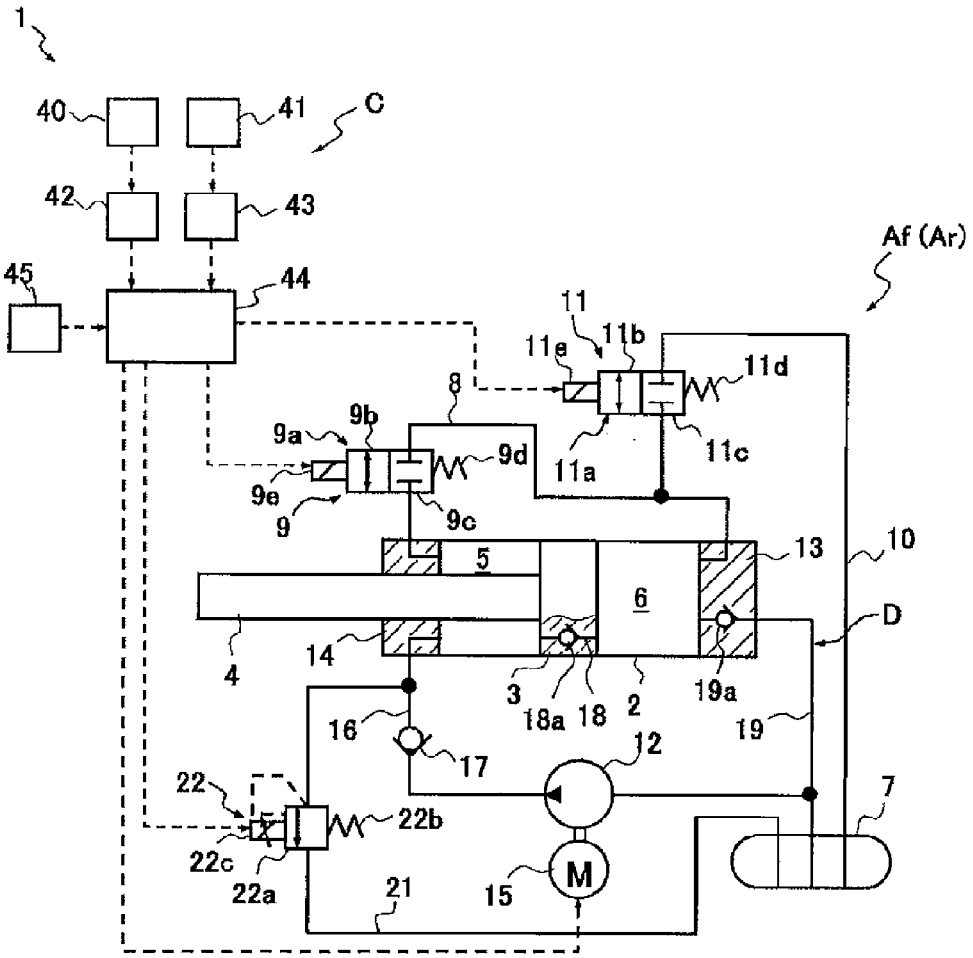
FIG. 2 is a detailed view of the railcar damping device according to this embodiment of this invention.

Next, referring to FIG. 2, a specific configuration of the railcar damping device 1 will be described.

Respective railcar damping devices 1 for expanding and contracting the front and rear actuators Af, Ar are configured similarly, and therefore, to avoid duplicate description, only the configuration of the railcar damping device 1 including the front side actuator Af will be described below, while specific description of the railcar damping device 1 including the rear side actuator Ar will be omitted.

The actuator Af includes a cylinder 2 coupled to one of the truck Tf and the vehicle body B of the railcar, a piston 3 inserted into the cylinder 2 to be free to slide, a rod 4 inserted into the cylinder 2 and coupled to the other of the truck Tf and the vehicle body B and to the piston 3, and a rod side chamber 5 and a piston side chamber 6 defined within the cylinder 2 by the piston 3. The actuator Af is constituted by a single rod type actuator. The railcar damping device 1 also includes a tank 7 storing working oil as a liquid that is supplied to and discharged from the cylinder 2, a first opening/closing valve 9 provided in a first passage 8 that connects the rod side chamber 5 to the piston side chamber 6 to be capable of opening and closing the first passage 8, a second opening/closing valve 11 provided in a second passage 10 that connects the piston side chamber 6 to the tank 7 to be capable of opening and closing the second passage 10, a pump 12 that supplies the working oil to the rod side chamber 5 from the tank 7, and a motor 15 that is rotated at a fixed rotation speed in order to drive the pump 12 to rotate. The working oil is charged into rod side chamber 5 and the piston side chamber 6, and a gas is charged into the tank 7 in addition to the working oil. It should be noted that there is no particular need to set the tank 7 in a pressurized condition by compressing the gas charged therein.

The actuator Af performs an expansion operation by driving the pump 12 in a condition where the first passage 8 is set in a communicative condition by the first opening/closing valve 9 and the second opening/closing valve 11 is closed. Further, the actuator Af performs a contraction operation by driving the pump 12 in a condition where the second passage 10 is set in a communicative condition by the second opening/closing valve 11 and the first opening/closing valve 9 is closed.

The respective parts of the actuator Af will now be described in detail.

The cylinder 2 is formed in a tubular shape. One end (a right end in FIG. 2) of the cylinder 2 is closed by a lid 13, and an annular rod guide 14 is attached to another end (a left end in FIG. 2). The rod 4 inserted into the cylinder 2 to be free to move is inserted into the rod guide 14 to be free to slide. The rod 4 projects to the exterior of the cylinder 2 at one end, and another end is coupled to the piston 3 inserted into the cylinder 2 to be free to slide.

An outer periphery of the rod 4 is sealed from the rod guide 14 by a seal member, not shown in the figures. As a result, the interior of the cylinder 2 is maintained in an airtight condition. As described above, the working oil is charged into the rod side chamber 5 and the piston side chamber 6 defined within the cylinder 2 by the piston 3. Another liquid suitable for an actuator may be used as the liquid charged into the cylinder 2 instead of the working oil.

In the actuator Af, the rod 4 is formed such that a sectional area thereof is half a sectional area of the piston 3. In other words, a pressure receiving surface area of the piston 3 on the rod side chamber 5 side is half a pressure receiving surface area of the piston 3 on the piston side chamber 6 side. Hence, when a pressure in the rod side chamber 5 is set to be identical during the expansion operation and the contraction operation, an identical thrust is generated during both expansion and contraction. Further, an amount of working oil supplied to and discharged from the rod side chamber 5 relative to a displacement amount of the actuator Af is identical on both the expansion and the contraction sides.

More specifically, when the actuator Af is caused to perform the expansion operation, the rod side chamber 5 and the piston side chamber 6 communicate via the first passage 8 such that the working oil pressure in the rod side chamber 5 and the working oil pressure in the piston side chamber 6 are equal. As a result, a thrust obtained by multiplying the pressure of the working oil by a pressure receiving surface area difference in the piston 3 between the rod side chamber 5 side and the piston side chamber 6 side is generated. When the actuator Af is caused to perform the contraction operation, on the other hand, communication between the rod side chamber 5 and the piston side chamber 6 is cut off such that the piston side chamber 6 communicates with the tank 7 via the second passage 10. As a result, a thrust obtained by multiplying the pressure of the working oil in the rod side chamber 5 by the pressure receiving surface area on the rod side chamber 5 side of the piston 3 is generated. Thus, during both expansion and contraction, the thrust generated by the actuator Af takes a value obtained by multiplying the pressure of the working oil in the rod side chamber 5 by half the sectional area of the piston 3. Therefore, the thrust of the actuator Af can be controlled by controlling the pressure of the rod side chamber 5 during both the expansion operation and the contraction operation.

In the actuator Af at this time, the pressure receiving surface area on the rod side chamber 5 side of the piston 3 is set at half the pressure receiving surface area on the piston side chamber 6 side. Therefore, when identical thrust is generated on both the expansion and contraction sides, the pressure in the rod side chamber 5 is identical on both the expansion side and the contraction side, making control simple. Further, the amount of working oil supplied to and discharged from the rod side chamber 5 relative to the displacement amount is also identical, and therefore an identical response is obtained on both the expansion and contraction sides.

It should be noted that the thrust of the actuator Af on the expansion and contraction sides can be controlled by the pressure in the rod side chamber 5 even when the pressure receiving surface area on the rod side chamber 5 side of the piston 3 is not set at half the pressure receiving surface area on the piston side chamber 6 side.

A free end (a left end in FIG. 2) of the rod 4 and the lid 13 that closes one end of the cylinder 2 are provided with attachment portions, not shown in the figures. The actuator Af can be interposed between the vehicle body B and the truck Tf of the railcar by these attachment portions.

The rod side chamber 5 and the piston side chamber 6 are connected by the first passage 8. The first opening/closing valve 9 is provided midway in the first passage 8. The first passage 8 connects the rod side chamber 5 and the piston side chamber 6 on the exterior of the cylinder 2, but instead, a passage connecting the rod side chamber 5 and the piston side chamber 6 may be provided in the piston 3.

The first opening/closing valve 9 is a solenoid opening/closing valve including a valve 9*a* having a communication position 9*b* and a cutoff position 9*c*, a spring 9*d* that biases the valve 9*a* to be switched to the cutoff position 9*c*, and a solenoid 9*e* which, when energized, switches the valve 9*a* to the communication position 9*b* against the spring 9*d*. When switched to the communication position 9*b*, the first opening/closing valve 9 opens the first passage 8 such that the rod side chamber 5 communicates with the piston side chamber 6. When switched to the cutoff position 9*c*, the first opening/closing valve 9 cuts off communication between the rod side chamber 5 and the piston side chamber 6.

The piston side chamber 6 and the tank 7 are connected by the second passage 10. The second opening/closing valve 11 is provided midway in the second passage 10. The second opening/closing valve 11 is a solenoid opening/closing valve including a valve 11*a* having a communication position 11*b* and a cutoff position 11*c*, a spring 11*d* that biases the valve 11*a* to be switched to the cutoff position 11*c*, and a solenoid 11*e* which, when energized, switches the valve 11*a* to the communication position 11*b* against the spring 11*d*. When switched to the communication position 11*b*, the second opening/closing valve 11 opens the second passage 10 such that the piston side chamber 6 communicates with the tank 7. When switched to the cutoff position 11*c*, the second opening/closing valve 11 cuts off communication between the piston side chamber 6 and the tank 7.

The pump 12 is driven by the motor 15. The pump 12 discharges the working oil in only one direction. A discharge port of the pump 12 communicates with the rod side chamber 5 via a supply passage 16, while a suction port of the pump 12 communicates with the tank 7. When driven by the motor 15, the pump 12 suctions the working oil from the tank 7 and supplies the working oil to the rod side chamber 5.

Since the pump 12 discharges the working oil in only one direction, an operation to switch a rotation direction thereof is not required. Therefore, a problem in which a discharge amount varies when the rotation direction is switched does not arise. Hence, an inexpensive gear pump or the like can be applied to the pump 12. Further, the rotation direction of the pump 12 is always the same direction, and therefore the motor 15 serving as a drive source for driving the pump 12 does not require a high response in relation to a rotation switch. Hence, an inexpensive motor may likewise be applied to the motor 15. A check valve 17 that prevents backflow of the working oil from the rod side chamber 5 to the pump 12 is provided in the supply passage 16.

In the railcar damping device 1, the working oil is supplied from the pump 12 to the rod side chamber 5 at a predetermined discharge flow rate. When the actuator Af of the railcar damping device 1 is caused to perform the expansion operation, the pressure in the rod side chamber 5 is regulated by opening the first opening/closing valve 9 and opening and closing the second opening/closing valve 11. When the actuator Af of the railcar damping device 1 is caused to perform the contraction operation, on the other hand, the pressure in the rod side chamber 5 is regulated by opening the second opening/closing valve 11 and opening and closing the first opening/closing valve 9. In so doing, thrust corresponding to the thrust command valve Ff described above can be obtained.

During the expansion operation, the rod side chamber 5 and the piston side chamber 6 are set in the communicative condition such that the pressure in the piston side chamber 6 is identical to the pressure in the rod side chamber 5. Hence, in the railcar damping device 1, the thrust of the actuator Af can be controlled by controlling the pressure in the rod side chamber 5 during both the expansion operation and the contraction operation.

The first opening/closing valve 9 and the second opening/closing valve 11 may be variable relief valves having an adjustable valve opening pressure so as to be capable of opening and closing. In this case, the thrust of the actuator Af can be adjusted during the expansion and contraction operations by adjusting the respective valve opening pressures of the first opening/closing valve 9 and the second opening/closing valve 11 rather than performing opening/closing operations thereon.

As described above, the thrust of the actuator Af can be adjusted, and to make thrust adjustment easier, the railcar damping device 1 is provided with an exhaust passage 21 that connects the rod side chamber 5 to the tank 7 and a variable relief valve 22 that is provided midway in the exhaust passage 21 and has a modifiable valve opening pressure.

The variable relief valve 22 is a proportional solenoid relief valve including a valve body 22*a* provided in the exhaust passage 21, a spring 22*b* that biases the valve body 22*a* so as to cut off the exhaust passage 21, and a proportional solenoid 22*c* which, when energized, generates thrust against the spring 22*b*. The valve opening pressure of the variable relief valve 22 can be adjusted by adjusting a current amount flowing to the proportional solenoid 22*c*.

In the variable relief valve 22, the pressure of the working oil in the rod side chamber 5 upstream of the exhaust passage 21 acts on the valve body 22*a* as a pilot pressure. When the pressure of the working oil acting on the valve body 22*a* of the variable relief valve 22 exceeds a relief pressure (the valve opening pressure), a resultant force of thrust generated by the pressure of the working oil in the rod side chamber 5 and the thrust generated by the proportional solenoid 22*c* overcomes a biasing force of the spring 22*b* that biases the valve body 22*a* in a direction for cutting off the exhaust passage 21, thereby causing the valve body 22*a* to retreat, and as a result, the exhaust passage 21 is opened.

In the variable relief valve 22, when the current amount supplied to the proportional solenoid 22*c* is increased, the thrust generated by the proportional solenoid 22*c* increases. Hence, when the current amount supplied to the proportional solenoid 22*c* is set at a maximum, the valve opening pressure reaches a minimum, and conversely, when no current is supplied to the proportional solenoid 22*c* at all, the valve opening pressure reaches a maximum.

Hence, by providing the exhaust passage 21 and the variable relief valve 22, the pressure in the rod side chamber 5 is identical to the valve opening pressure of the variable relief valve 22 during the expansion and contraction operations of the actuator Af. Therefore, by adjusting the valve opening pressure of the variable relief valve 22, the pressure in the rod side chamber 5 can be adjusted easily.

By adjusting the valve opening pressure of the variable relief valve 22 in this manner, the thrust of the actuator Af is controlled. There is therefore no need to provide a sensor in order to adjust the thrust of the actuator Af, no need to open and close the first opening/closing valve 9 and the second opening/closing valve 11 at high speed, and no need to provide a variable relief valve having a function for opening and closing the first opening/closing valve 9 and the second opening/closing valve 11. As a result, the railcar damping device 1 can be constructed inexpensively, and a robust system in terms of both hardware and software can be constructed.

When a proportional solenoid relief valve in which the valve opening pressure can be varied proportionally in accordance with the applied current amount is used as the variable relief valve 22, the valve opening pressure can be controlled easily. However, the variable relief valve 22 is not limited to a proportional solenoid relief valve, and any relief valve having an adjustable valve opening pressure may be used.

When an excessive input is input into the actuator Af in an expansion/contraction direction such that the pressure in the rod side chamber 5 exceeds the valve opening pressure of the variable relief valve 22 regardless of the open/closed condition of the first opening/closing valve 9 and the second opening/closing valve 11, the variable relief valve 22 opens the exhaust passage 21 such that the rod side chamber 5 communicates with the tank 7. As a result, the pressure in the rod side chamber 5 escapes into the tank 7, and therefore the entire system of the railcar damping device 1 can be protected. Hence, by providing the exhaust passage 21 and the variable relief valve 22, the system can be protected.

The railcar damping device 1 includes a damper circuit D. The damper circuit D causes the actuator Af to function as a damper when the first opening/closing valve 9 and the second opening/closing valve 11 are both closed. The damper circuit D includes a rectifying passage 18 that is formed in the piston 3 to allow the working oil to flow only from the piston side chamber 6 toward the rod side chamber 5, and a suction passage 19 that allows the working oil to flow only from the tank 7 toward the piston side chamber 6. Further, the railcar damping device 1 includes the exhaust passage 21 and the variable relief valve 22, and therefore, when the actuator Af functions as a damper, the variable relief valve 22 functions as a damping valve.

More specifically, the rectifying passage 18 connects the piston side chamber 6 to the rod side chamber 5, and a check valve 18*a* is provided midway therein. The check valve 18*a* turns the rectifying passage 18 into a one-way passage that allows the working oil to flow only from the piston side chamber 6 toward the rod side chamber 5. The suction passage 19, meanwhile, connects the tank 7 to the piston side chamber 6, and a check valve 19*a* is provided midway therein. The check valve 19*a* turns the suction passage 19 into a one-way passage that allows the working oil to flow only from the tank 7 toward the piston side chamber 6.

It should be noted that by interposing a check valve that allows the working oil to flow only from the piston side chamber 6 toward the rod side chamber 5 in the cutoff position 9*c* of the first opening/closing valve 9, the first passage 8 may also be used as the rectifying passage 18. Further, by interposing a check valve that allows the working oil to flow only from the tank 7 toward the piston side chamber 6 in the cutoff position 11*c* of the second opening/closing valve 11, the second passage 10 may also be used as the suction passage 19.

By providing the damper circuit D configured as described above, when the first opening/closing valve 9 and the second opening/closing valve 11 of the railcar damping device 1 are switched to their respective cutoff positions 9*c*, 11*c*, the rod side chamber 5, the piston side chamber 6, and the tank 7 are connected in a row by the rectifying passage 18, the suction passage 19, and the exhaust passage 21. Since the rectifying passage 18, the suction passage 19, and the exhaust passage 21 allow the working oil to flow in only one direction, when the actuator Af is caused to expand and contract by an external force, working oil discharged from the cylinder 2 is returned to the tank 7 through the exhaust passage 21, while a working oil deficiency in the cylinder 2 is alleviated by supplying working oil into the cylinder 2 from the tank 7 through the suction passage 19.

At this time, the variable relief valve 22 serves as resistance to the flow of working oil, thereby functioning as a pressure control valve that regulates the pressure in the cylinder 2 to the valve opening pressure. Accordingly, the actuator Af functions as a passive uniflow damper.

During a failure in which the respective components of the railcar damping device 1 cannot be energized, the valves 9*a*, 11*a* of the first opening/closing valve 9 and the second opening/closing valve 11 are pressed by the springs 9*d*, 11*d* so as to be switched to their respective cutoff positions 9*c*, 11*c*. At this time, the variable relief valve 22 functions as a pressure control valve having a valve opening pressure that is fixed in a maximum condition. During a failure, therefore, the actuator Af automatically functions as a passive damper.

Instead of providing the variable relief valve 22 and the exhaust passage 21, the damper circuit D may be constituted separately by a passage that connects the rod side chamber 5 and the tank 7 and a damping valve provided midway in the passage.

To cause the actuators Af, Ar to generate a desired thrust in an expansion direction, the controller C rotates the motor 15 to supply working oil from the pump 12 into the cylinder 2, switches the respective first opening/closing valves 9 to the communication position 9*b*, and switches the second opening/closing valves 11 to the cutoff position 11*c*. As a result, the rod side chamber 5 and the piston side chamber 6 enter the communicative condition such that working oil is supplied thereto from the pump 12 and the piston 3 is pressed in the expansion direction (leftward in FIG. 2). The actuators Af, Ar thus generate thrust in the expansion direction. At this time, the actuators Af, Ar generate expansion direction thrust having a magnitude obtained by multiplying the pressure in the rod side chamber 5 and the piston side chamber 6 by the pressure receiving surface area difference in the piston 3 between the piston side chamber 6 side and the rod side chamber 5 side.

When the pressure in the rod side chamber 5 and the piston side chamber 6 exceeds the valve opening pressure of the variable relief valve 22, the variable relief valve 22 opens such that a part of the working oil supplied from the pump 12 escapes into the tank 7 through the exhaust passage 21. Thus, the pressure in the rod side chamber 5 and the piston side chamber 6 is controlled by the valve opening pressure of the variable relief valve 22, which is determined in accordance with the current amount applied to the variable relief valve 22.

To cause the actuators Af, Ar to generate a desired thrust in a contraction direction, on the other hand, the controller C rotates the motor 15 to supply working oil from the pump 12 into the rod side chamber 5, switches the first opening/closing valves 9 to the cutoff position 9*c*, and switches the second opening/closing valves 11 to the communication position 11*b*. As a result, the piston side chamber 6 and the tank 7 enter the communicative condition such that working oil is supplied to the rod side chamber 5 from the pump 12, and as a result, the piston 3 is pressed in the contraction direction (rightward in FIG. 2). The actuators Af, Ar thus generate thrust in the contraction direction. At this time, the actuators Af, Ar generate contraction direction thrust having a magnitude obtained by multiplying the pressure in the rod side chamber 5 by the pressure receiving surface area on the rod side chamber 5 side of the piston 3.

At this time, similarly to the operation for generating expansion direction thrust, the pressure in the rod side chamber 5 is controlled by the valve opening pressure of the variable relief valve 22, which is determined in accordance with the current amount applied to the variable relief valve 22.

Further, by switching the open/closed condition of the first opening/closing valve 9 and the second opening/closing valve 11 regardless of a driving condition of the motor 15, the actuators Af, Ar can be caused to function as dampers as well as actuators. Hence, troublesome and rapid valve switching operations are not required, and therefore a highly responsive and reliable system can be provided.

Since single rod type actuators are used as the actuators Af, Ar, a stroke length is easier to secure than with double rod type actuators. Therefore, an overall length of the actuators Af, Ar is shortened, and as a result, the actuators Af, Ar can be installed in the railcar more easily.

As regards the working oil supply from the pump 12 and the working oil flow during the expansion and contraction operations, the working oil passes through the rod side chamber 5 and the piston side chamber 6 of the actuators Af, Ar in that order, and is ultimately recirculated to the tank 7. Therefore, even when gas is intermixed into the rod side chamber 5 or the piston side chamber 6, the gas is automatically discharged into the tank 7 by the expansion and contraction operations of the actuators Af, Ar. As a result, a reduction in responsiveness during thrust generation due to intermixing of gas into the working oil can be prevented.

Hence, when the railcar damping device 1 is manufactured, troublesome operations such as assembling the railcar damping device 1 in oil or in a vacuum environment are not required. Further, an advanced degassing operation need not be performed on the working oil. As a result, a productivity of the railcar damping device 1 is improved, and manufacturing costs can be reduced.

Furthermore, even when gas is intermixed into the rod side chamber 5 and the piston side chamber 6, the gas is automatically discharged into the tank 7 by the expansion and contraction operations of the actuators Af, Ar. Therefore, frequent maintenance operations for the purpose of performance recovery are not required. As a result, labor and cost expended on maintenance can be reduced.

Next, referring mainly to FIGS. 3 and 4, the configuration of the controller C will be described.

As shown in FIG. 1, the controller C includes a front side acceleration sensor 40 that detects the lateral direction acceleration $\alpha f$ of the vehicle body front portion Bf serving as a front side of the vehicle body in the horizontal lateral direction relative to the vehicle advancement direction, and a rear side acceleration sensor 41 that detects the lateral direction acceleration $\alpha r$ of the vehicle body rear portion Br serving as a rear side of the vehicle body in the horizontal lateral direction relative to the vehicle advancement direction. Further, as shown in FIGS. 2 and 3, the controller C includes band pass filters 42, 43 that remove steady-state acceleration during travel on a curve, a drift component, and noise from the lateral direction accelerations $\alpha f$, $\alpha r$, and a control unit 44 that calculates command values from the lateral direction accelerations $\alpha f$, $\alpha r$ filtered by the band pass filters 42, 43 and outputs the calculated command values to the motor 15, the solenoid 9*e* of the first opening/closing valve 9, the solenoid 11*e* of the second opening/closing valve 11, and the proportional solenoid 22*c* of the variable relief valve 22. Thus, the controller C controls the thrust of the respective actuators Af, Ar.

It should be noted that since the band pass filters 42, 43 remove the steady-state acceleration during travel on a curve included in the lateral direction acceleration $\alpha f$ and the lateral direction acceleration $\alpha r$, the controller C can suppress only vibration that causes passenger comfort to deteriorate.

Figure 3:
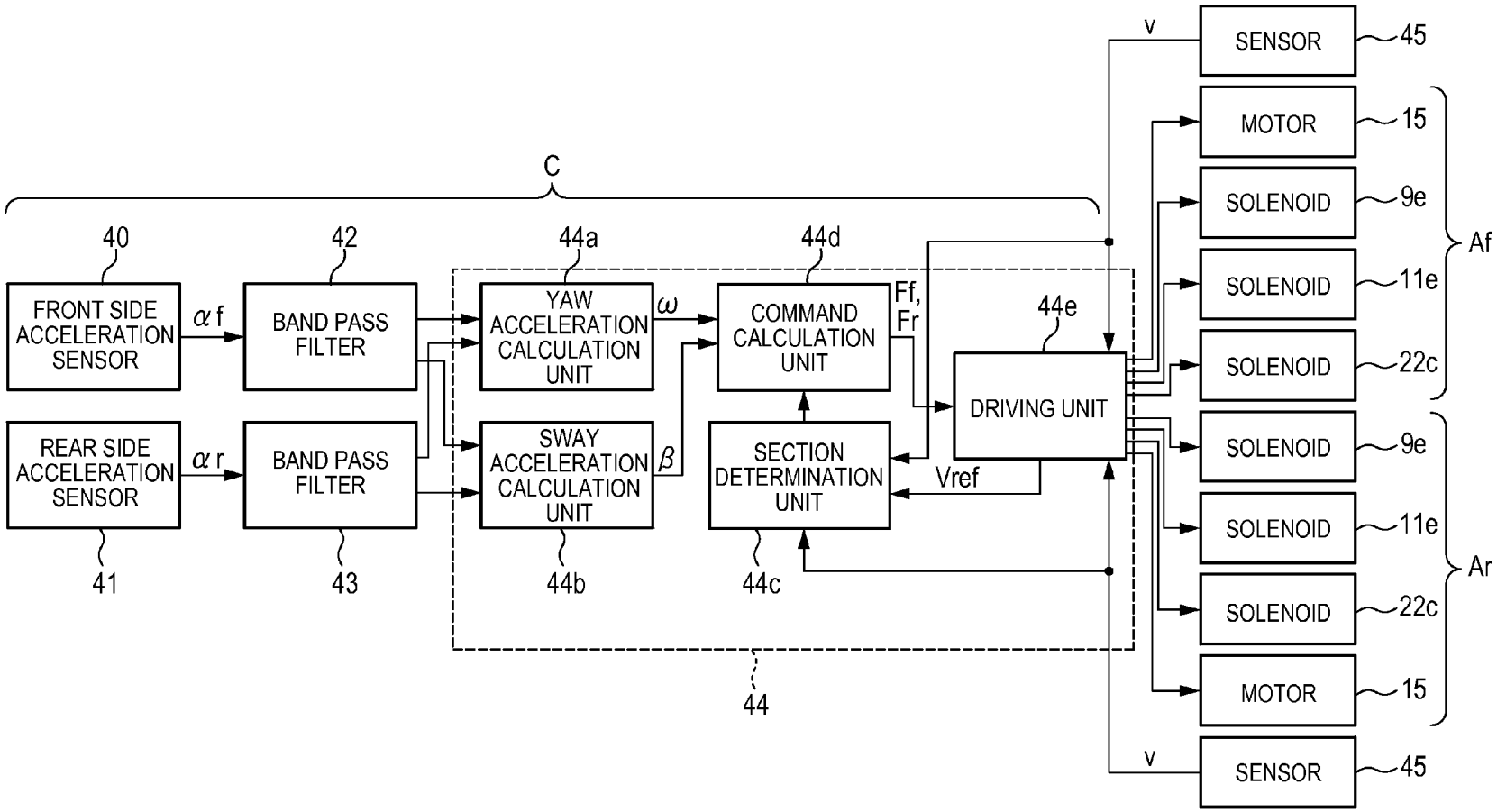
FIG. 3 is a control block diagram of a controller provided in the railcar damping device according to this embodiment of this invention.

As shown in FIG. 3, the control unit 44 includes a yaw acceleration calculation unit 44*a* that calculates the yaw acceleration $\omega$ about the vehicle body center G directly above the front and rear trucks Tf, Tr on the basis of the lateral direction acceleration $\alpha f$ and the lateral direction acceleration $\alpha r$, a sway acceleration calculation unit 44*b* that calculates the sway acceleration $\beta$ of the vehicle body center G of the vehicle body B on the basis of the lateral direction acceleration $\alpha f$ and the lateral direction acceleration $\alpha r$, a section determination unit 44*c* that determines a section type of a current travel section of the railcar, a command calculation unit 44*d* that calculates the thrust command values Ff, Fr indicating the thrust to be generated individually by the front and rear actuators Af, Ar on the basis of the yaw acceleration $\omega$ and the sway acceleration $\beta$, and a driving unit 44*e* that drives the motor 15, the solenoid 9*e* of the first opening/closing valve 9, the solenoid 11*e* of the second opening/closing valve 11, and the proportional solenoid 22*c* of the variable relief valve 22 on the basis of the thrust command values Ff, Fr.

As hardware, the controller C includes, for example, an A/D converter for converting signals output by the front side acceleration sensor 40 and the rear side acceleration sensor 41 into digital signals and importing the digital signals, the aforesaid band pass filters 42, 43, a storage device such as a ROM (Read Only Memory) storing a program used for the processing required to control the railcar damping device 1, a calculation device such as a CPU (Central Processing Unit) that executes the processing on the basis of the program, and a storage device such as a RAM (Random Access Memory)

that provides the CPU with a storage area. The respective units provided in the control unit 44 of the controller C may be realized by having the CPU execute the program for performing the processing described above. Alternatively, instead of providing the band pass filters 42, 43 as hardware, the band pass filters 42, 43 may be realized on software by having the CPU execute the program.

The lateral direction accelerations $\alpha f$, $\alpha r$ are set using an axis that passes through the center of the vehicle body B in the advancement direction (a left-right direction in FIG. 1) as a reference so as to be positive acceleration when oriented in a direction traveling toward the right side (upward in FIG. 1) and negative acceleration when oriented in a direction traveling toward the right side (downward in FIG. 1). The yaw acceleration calculation unit 44*a* calculates the yaw acceleration $\omega$ about the vehicle body center G directly above the front side truck Tf and the rear truck Tr, respectively, by halving a difference between the front side lateral direction acceleration $\alpha f$ and the rear side lateral direction acceleration $\alpha r$. The sway acceleration calculation unit 44*b* calculates the sway acceleration $\beta$ of the vehicle body center G by halving a sum of the lateral direction acceleration $\alpha f$ and the lateral direction acceleration $\alpha r$.

To calculate the yaw acceleration $\omega$, the front side acceleration sensor 40 is preferably disposed in the vicinity of the front side actuator Af on a line extending in a front-rear direction or a diagonal direction including the vehicle body center G of the vehicle body B. Similarly, the rear side acceleration sensor 41 is preferably disposed in the vicinity of the rear side actuator Ar on a line extending in a front-rear direction or a diagonal direction including the vehicle body center G of the vehicle body B.

The yaw acceleration $\omega$ can also be calculated from respective distances between the vehicle body center G and the acceleration sensors 40, 41, positional relationships therebetween, and the lateral direction accelerations $\alpha f$, $\alpha r$. Therefore, installation positions of the acceleration sensors 40, 41 may be set as desired. In this case, instead of determining the yaw acceleration $\omega$ by halving the difference between the lateral direction acceleration $\alpha f$ and the lateral direction acceleration $\alpha r$, the yaw acceleration $\omega$ is calculated from the difference between the lateral direction acceleration $\alpha f$ and the lateral direction acceleration $\alpha r$, the respective distances between the vehicle body center G and the acceleration sensors 40, 41, and the positional relationships therebetween.

More specifically, when a front-rear direction distance between the front side acceleration sensor 40 and the vehicle body center G is set as Lf and a front-rear direction distance between the rear side acceleration sensor 41 and the vehicle body center G is set as Lr, the yaw acceleration $\omega$ is calculated from $\omega=(\alpha f-\alpha r)/(Lf+Lr)$. It should be noted that the yaw acceleration $\omega$ may be detected using a yaw acceleration sensor instead of being calculated from the accelerations detected by the front side acceleration sensor 40 and the rear side acceleration sensor 41.

The section determination unit 44*c* determines whether the section type of the current travel section of the railcar is an open section or a tunnel section on the basis of a speed deviation $\epsilon$, which is a speed difference between a target rotation speed Vref and an actual rotation speed V of the motor 15. Here, "open section" is an inclusive term encompassing all sections other than tunnels, i.e. non-tunnel sections.

The determination performed by the section determination unit 44*c* will now be described in detail.

First, content of control executed by the control unit 44 to drive the motor 15 at a fixed rotation speed will be described. The motor 15 is driven by the driving unit 44*e* of the control unit 44. The motor 15 is driven by the driving unit 44*e* to rotate at a fixed rotation speed.

More specifically, the control unit 44 senses the rotation speed of the motor 15 using a rotation position sensor 45 constituted by a resolver, a Hall element, or the like that detects a rotation position of a rotor, not shown in the figures, of the motor 15. The driving unit 44*e* then calculates the rotation speed V from the rotation position detected by the rotation position sensor 45, and controls the motor 15 by feeding back the rotation speed V.

To describe this in more detail, in order to drive the motor 15 at the fixed rotation speed, the driving unit 44*e* includes a speed loop that feeds back the detected rotation speed V of the motor 15 through negative feedback of the rotation speed V, a current loop provided in the speed loop, and a driver for applying a voltage to a winding, not shown in the figures, of the motor 15. In the speed loop, the fixed rotation speed of the motor 15 is set at the target rotation speed Vref, a target current value is determined by performing PI compensation, PID compensation, or the like on the speed deviation $\epsilon$ between the target rotation speed Vref and the rotation speed V, and the determined target current value is input into the current loop. In the current loop, a voltage command value to be ultimately applied to the driver is generated by feeding back an actual current flowing through the motor 15. The driving unit 44*e* controls the motor 15 by applying the current to the winding of the motor 15 via the driver.

The motor 15 is thus driven by the driving unit 44*e* at the fixed rotation speed. When the railcar travels through a tunnel section, however, a large external force acts on the vehicle body B due to airflow disturbance around the vehicle body B. Therefore, the vehicle body B vibrates at a larger amplitude during travel through a tunnel section than during travel through an open section.

The external force acting on the vehicle body B also acts on the actuators Af, Ar, leading to variation in the pressure in the rod side chamber 5 and great variation in the thrust output by the actuators Af, Ar in order to suppress the vibration of the vehicle body B. This variation affects a discharge pressure of the pump 12, causing the rotation speed of the pump 12 to become oscillatory. When the rotation speed of the pump 12 becomes oscillatory, the rotation speed of the motor 15 connected thereto naturally also becomes more oscillatory in a tunnel section than in an open section. During travel through a tunnel section, therefore, the speed deviation $\epsilon$ between the actual rotation speed V and the target rotation speed Vref tends to be larger than during travel through an open section.

Hence, when an absolute value of the speed deviation $\epsilon$ serving as the difference between the target rotation speed Vref and the actual rotation speed V of the motor 15 is large, it may be determined that the railcar is traveling through a tunnel section.

Accordingly, the section determination unit 44*c* determines that the railcar is traveling through a tunnel section when the absolute value of the speed deviation $\epsilon$ serving as the difference between the target rotation speed Vref and the actual rotation speed V of the motor 15 exceeds a speed threshold Vb. Further, when the absolute value of the speed deviation $\epsilon$ is equal to or smaller than the speed threshold Vb, the section determination unit 44*c* determines that the railcar is traveling through an open section. The speed threshold Vb at this time is set at an optimum value for the determination by actually causing the railcar to travel and collecting data relating to the speed deviation $\epsilon$ during travel in an open section and data relating to the speed deviation $\epsilon$ during travel in a tunnel section experientially. For example, the speed threshold Vb may be set at an average value of the speed deviation ϵ during travel in a tunnel section, a value calculated from the average value−a standard deviation×a (a=1, 2) or an expected value thereof, or set at a value calculated from an upper limit value or an average value of the speed deviation ϵ during travel in an open section+a standard deviation×a (a=1, 2).

As shown in FIG. 3, the target rotation speed Vref may be obtained from the driving unit 44*e* on each occasion, obtained from another device, or stored in advance in the section determination unit 44*c*.

Hence, in the railcar damping device 1, the section type can be determined without monitoring the travel position of the railcar, thereby eliminating the need to obtain travel position information from another device.

As described above, the section determination unit 44*c* is capable of determining the section type of the current travel section of the railcar. If, however, in a case where the absolute value of the speed deviation ϵ between the target rotation speed Vref and the rotation speed V obtained in a single sampling operation exceeds the speed threshold Vb such that a tunnel section is determined, the vehicle body B vibrates greatly due to an external force, the tunnel section may be determined erroneously even when the railcar is actually traveling in an open section. Similarly, an open section may be determined erroneously when the speed deviation ϵ falls to or below the speed threshold Vb even though the railcar is actually traveling in a tunnel section.

Hence, to improve the precision of the section type determination, the section determination unit 44*c* calculates a root mean square of the speed deviation ϵ, determines that the travel position of the railcar is in a tunnel section when the root mean square exceeds a predetermined speed threshold Vb, and determines that the travel position of the railcar is in an open section when the root mean square is equal to or smaller than the speed threshold Vb.

The speed threshold Vb in this case is set in order to determine the section type from the value of the root mean square of the speed deviation ϵ, and is therefore not always set at an identical value to the speed threshold Vb described above, which is set in relation to the absolute value of the speed deviation ϵ. The root mean square of the speed deviation ϵ is obtained by calculating a square root of a value obtained by dividing a sum of squares of a predetermined number of speed deviations ϵ by the predetermined number. The number of speed deviations ϵ used to obtain the root mean square of the speed deviation ϵ is set as desired in accordance with a sampling time, a control frequency, and a time required for the determination by the section determination unit 44*c*. For example, the number of speed deviations ϵ is set at a sample number obtained over a period of 0.5 to 2 seconds.

By employing the root mean square of the speed deviation ϵ in the determination in this manner, even when the absolute value of the speed deviation ϵ increases or decreases momentarily, an effect thereof on the root mean square of the speed deviation ϵ is small. Hence, by comparing the root mean square of the speed deviation ϵ with the speed threshold Vb, an erroneous determination of a tunnel section is unlikely to occur even when the vehicle body B vibrates greatly due to an external force occurring during travel in an open section. Moreover, an erroneous determination of an open section is unlikely to occur even when the speed deviation ϵ falls to or below the speed threshold Vb momentarily during travel in a tunnel section. As a result, the section type of the current travel section of the railcar can be determined more accurately.

When the determination is performed using the root mean square of the speed deviation ϵ, the speed threshold Vb is set at an optimum value for the determination by actually causing the railcar to travel and collecting data relating to the root mean square of the speed deviation ϵ during travel in an open section and data relating to the root mean square of the speed deviation ϵ during travel in a tunnel section experientially. For example, the speed threshold Vb may be set at an average value of the root mean square of the speed deviation ϵ during travel in a tunnel section, a value calculated from the average value−a standard deviation×a (a=1, 2) or an expected value thereof, or set at a value calculated from an upper limit value or an average value of the root mean square of the speed deviation ϵ during travel in an open section+a standard deviation×a (a=1, 2).

When the section determination unit 44*c* determines an open section again after determining a tunnel section, the section determination unit 44*c* may determine a plurality of consecutive open sections.

As described above, the section determination unit 44*c* is capable of determining whether the section type of the current travel section of the railcar is an open section or a tunnel section. In addition, the section determination unit 44*c* determines whether or not the absolute value of the thrust of the actuators Af, Ar exceeds a thrust threshold. In so doing, the section determination unit 44*c* can determine whether the open section is a straight section or a curved section, and whether or not an abnormality has occurred in the railcar damping device 1.

More specifically, in addition to the section type determination using the speed deviation ϵ, described above, the section determination unit 44*c* determines whether or not the absolute value of the thrust generated by the actuators Af, Ar exceeds a thrust threshold Fc. The thrust that is actually output by the actuators Af, Ar can be obtained by detecting a torque of an output shaft, not shown in the figures, of the motor 15. The output shaft of the motor 15 is coupled to an input shaft of the pump 12. Further, a discharge pressure of the pump 12 corresponds to the pressure of the rod side chamber 5. Hence, by obtaining a relationship between the actuators Af, Ar and the torque in advance and detecting the torque of the output shaft of the motor 15, the thrust output by the actuators Af, Ar can be obtained.

It should be noted that the detected torque includes a component generated by a kinetic friction force in a movable portion of the pump 12. Therefore, when the component generated by the kinetic friction force is too large to be ignored, this component may be removed by calculation.

Further, the thrust output by the actuators Af, Ar is adjusted in accordance with the valve opening pressure of the variable relief valve 22, and therefore the thrust can also be estimated according to the current amount supplied to the proportional solenoid 22*c* of the variable relief valve 22. Furthermore, the torque of the motor 15 has a proportional relationship with the current flowing through the motor 15, and therefore the thrust of the actuators Af, Ar may also be obtained by detecting the current flowing through the motor 15.

Figure 4:
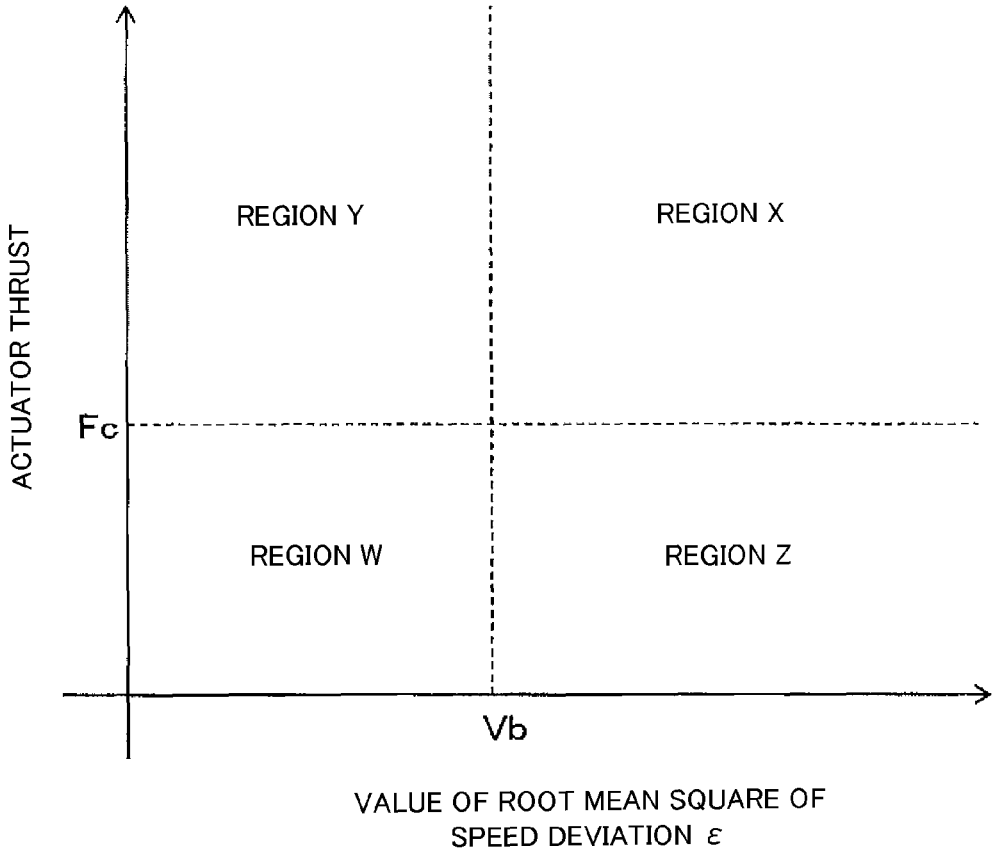
FIG. 4 is a view illustrating content of a section type determination performed by a section determination unit.

As shown in FIG. 4, the section determination unit 44*c* determines that the section type is a curved section when the section type of the current travel section of the railcar has been determined as an open section and the absolute value of the thrust generated by the actuators Af, Ar exceeds the thrust threshold Fc (a region Y in FIG. 4). When the section type of the current travel section of the railcar has been determined as an open section but the absolute value of the thrust generated by the actuators Af, Ar is equal to or smaller than the thrust threshold Fc, on the other hand, the section determination unit 44*c* determines that the section type is a straight section (a region W in FIG. 4).

In a curved section, steady-state acceleration known as over-centrifugal acceleration which, depending on a cant, cannot be alleviated is typically exerted on the vehicle body B. A waveband of vibration generated in the vehicle body B by this steady-state acceleration is close to a waveband of the vibration of the vehicle body B that is to be suppressed in order to improve the passenger comfort. It is therefore difficult to eliminate the steady-state acceleration completely using the band pass filters 42, 43. As a result, in a curved section, the steady-state acceleration is added to the vibration of the vehicle body B caused by external force. Hence, the absolute value of the thrust generated by the actuators Af, Ar in a curved section tends to be larger than the absolute value of the thrust generated by the actuators Af, Ar in a straight section.

The thrust threshold Fc is set at an optimum value for the determination by, for example, actually causing the railcar to travel and collecting data indicating the thrust generated by the actuators Af, Ar during travel in a straight section of an open section and data indicating the thrust generated by the actuators Af, Ar during travel in a curved section of an open section experientially. For example, the thrust threshold Fc may be set at a lower limit value of the absolute value of the thrust generated by the actuators Af, Ar during travel in a curved section, a value calculated from an average value−a standard deviation×a (a=1, 2) or an expected value thereof, or set at an upper limit value of the absolute value of the thrust generated by the actuators Af, Ar during travel in a straight section or a value calculated from an average value+a standard deviation×a (a=1, 2).

Hence, when the railcar travels in an open section, the railcar damping device 1 can determine whether the section type of the current travel section of the railcar is a curved section or a straight section of the open section by determining whether or not the absolute value of the thrust generated by the actuators Af, Ar exceeds the thrust threshold Fc.

Furthermore, when the section determination unit 44*c* determines that the section type of the current travel section of the railcar is a tunnel section and the absolute value of the thrust generated by the actuators Af, Ar is equal to or smaller than the thrust threshold Fc, it is determined that the railcar damping device 1 has failed (a region Z in FIG. 4).

More specifically, in a tunnel section, the absolute value of the thrust generated by the actuators Af, Ar is larger than in an open section, and therefore, when the absolute value is larger than the thrust threshold Fc, it may be determined that the railcar damping device 1 is functioning normally during travel through a tunnel section (a region X in FIG. 4). When the absolute value of the thrust generated by the actuators Af, Ar is equal to or smaller than the thrust threshold Fc, on the other hand, it may be determined that since the thrust of the actuators Af, Ar has decreased even though the railcar is traveling through a tunnel section, the railcar damping device 1 has failed (the region Z in FIG. 4).

When the control for suppressing the vibration of the vehicle body B is continued as is after determining that the railcar damping device 1 has failed, the vibration of the vehicle body B may increase, leading to a reduction in the passenger comfort of the vehicle. Therefore, the railcar damping device 1 activates the damper circuit D described above by halting the power supply to the motor 15, the first opening/closing valve 9, the second opening/closing valve 11, and the variable relief valve 22. As a result, the actuators Af, Ar function as passive dampers. By causing the actuators Af, Ar to function as passive dampers during a failure in this manner, the actuators Af, Ar can be caused to generate damping force with which the vibration of the vehicle body B can be suppressed.

It should be noted that the determination as to whether the open section is a straight section or a curved section and the determination of failure in the railcar damping device 1 may be performed similarly using the thrust command values Ff, Fr of the actuators Af, Ar rather than the thrust of the actuators Af, Ar.

Figure 5:
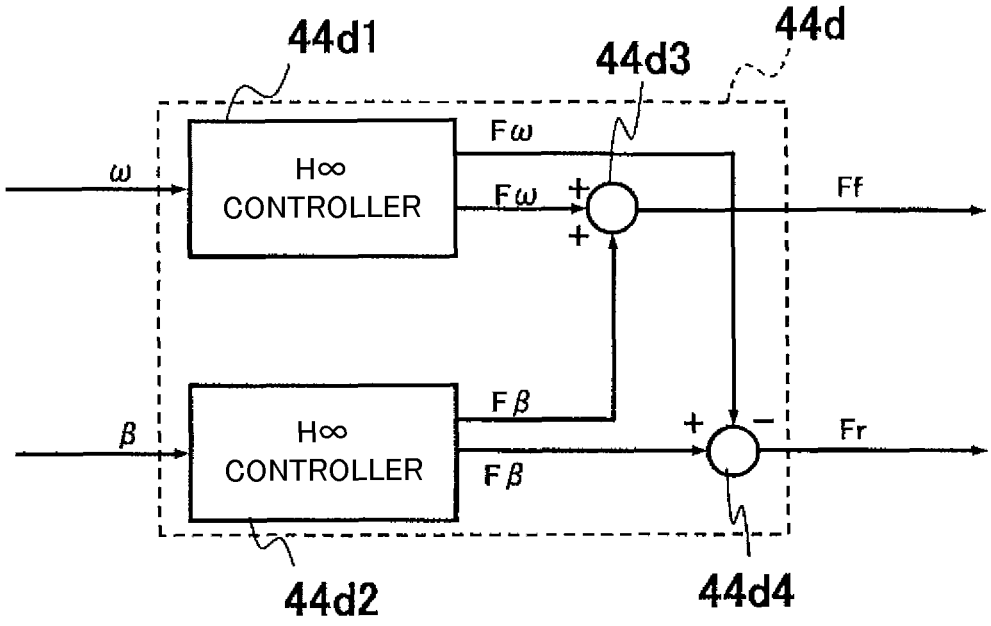
FIG. 5 is a control block diagram of a command calculation unit of the controller provided in the railcar damping device according to this embodiment of this invention.

As shown in FIG. 5, the command calculation unit 44*d* is configured to include H ∞ controllers 44*d*1, 44*d*2. The command calculation unit 44*d* includes the H ∞ controller 44*d*1 that calculates a thrust Fω (a yaw command value) for suppressing yaw vibration of the vehicle body B from the yaw acceleration ω calculated by the yaw acceleration calculation unit 44*a*, the H ∞ controller 44*d*2 that calculates a thrust Fβ (a sway command value) for suppressing sway vibration of the vehicle body B from the sway acceleration β calculated by the sway acceleration calculation unit 44*b*, an adder 44*d*3 that calculates the thrust command value Ff indicating the thrust to be output by the front side actuator Af by adding together the thrust Fω and the thrust Fβ, and a subtractor 44*d*4 that calculates the thrust command value Fr indicating the thrust to be output by the rear side actuator Ar by subtracting the thrust Fω from the thrust Fβ.

The H ∞ controllers 44*d*1, 44*d*2 hold a control gain for use during travel in a straight section, a control gain for use in a curved section, and a control gain for use in a tunnel section. The H ∞ controllers 44*d*1, 44*d*2 calculate the thrust Fω and the thrust Fβ by selecting a corresponding control gain in accordance with the determination result of the section determination unit 44*c*.

It should be noted that of the control gains used to calculate the thrust Fω, for example, the control gain for use in a curved section is set to be larger than the control gain for use in a straight section, and the control gain for use in a tunnel section is set to be larger than the control gain for use in a curved section. In so doing, the control gains are set at optimum values for the respective sections. The control gains used to calculate the thrust Fβ are likewise set at optimum values for the respective sections. At this time, the sway acceleration β includes steady-state acceleration in a curved section, and therefore the control gain for use in a curved section is preferably set to be smaller than the control gain for use in a straight section and the control gain for use in a tunnel section is preferably set to be larger than the control gain for use in a straight section.

Since H ∞ control is executed by the command calculation unit 44*d*, a superior damping effect can be obtained irrespective of a frequency of the vibration input into the vehicle body B, and as a result, a high degree of robustness can be obtained. However, this does not preclude the use of control other than H ∞ control. Therefore, for example, the front and rear actuators Af, Ar may also be controlled using skyhook control in which a lateral direction speed is obtained from the lateral direction accelerations αf, αr and a thrust command value is determined by multiplying the lateral direction speed by a skyhook damping coefficient. Further, instead of the controlling the thrust values of the front and rear actuators Af, Ar in conjunction from the yaw acceleration ω and the sway acceleration β, the front side actuator Af and the rear side actuator Ar may be controlled independently of each other.

As shown in FIG. 3, the driving unit 44*e* outputs control commands to cause the actuators Af, Ar to generate thrust corresponding to the respective thrust command values Ff, Fr. More specifically, the driving unit 44*e* calculates control commands to be output to the motor 15, the solenoid 9*e* of the first opening/closing valve 9, the solenoid 11*e* of the second opening/closing valve 11, and the proportional solenoid 22*c* of the variable relief valve 22, and outputs the calculated control commands. Further, when the control commands are calculated from the thrust command values Ff, Fr, the control commands may be calculated using feedback control by feeding back the thrust output by the actuators Af, Ar at that time.

More specifically, as described above, the driving unit 44*e* calculates the control commands to be output to the solenoid 9*e* of the first opening/closing valve 9, the solenoid 11*e* of the second opening/closing valve 11, and the proportional solenoid 22*c* of the variable relief valve 22 from the thrust command values Ff, Fr, and outputs the calculated control commands.

Hence, the railcar damping device 1 determines whether the section type of the current travel section of the railcar is an open section or a tunnel section using the section determination unit 44*c*, and selects the appropriate control gain for the section type of the current travel section of the railcar on the basis of the determination result. The railcar damping device 1 then calculates the thrust command values Ff, Fr in order to control the actuators Af, Ar. As a result, the vibration of the vehicle body B of the railcar, which vibrates in different vibration modes depending on the section type, can be suppressed effectively.

According to the railcar damping device 1, therefore, the section determination unit 44*c* determines whether the section type of the current travel section of the railcar is an open section or a tunnel section on the basis of the speed deviation $\epsilon$, i.e. the speed difference between the target rotation speed Vref and the actual rotation speed V of the motor 15, and as a result, the section type can be determined without obtaining travel position information and section type information relating to the railcar from another device such as a vehicle monitoring device.

Further, according to the railcar damping device 1, since there is no need to obtain travel position information and section type information relating to the railcar from another device such as a vehicle monitoring device, an interface for establishing a connection with the vehicle monitoring device or the like is not required, and therefore the railcar damping device 1 can be installed easily even in a railcar not having a developed vehicle information transmission facility, such as a railcar used on a narrow gauge railway.

Moreover, in this embodiment, the section determination unit 44*c* is also capable of differentiating between a straight section and a curved section of an open section, and therefore a more appropriate control gain for the section type can be selected. As a result, the vibration of the vehicle body B of the railcar can be suppressed even more effectively.

Further, when the section determination unit 44*c* determines that the section type of the current travel section of the railcar is a tunnel section and the thrust or the thrust command values of the actuators Af, Ar are equal to or smaller than the thrust threshold, the railcar damping device 1 is determined to be in a state of failure. Hence, when the railcar damping device 1 is in the state of failure, the control for suppressing the vibration of the vehicle body B is not continued. Furthermore, when the railcar damping device 1 is determined to be in the state of failure, the actuators Af, Ar are caused to function as passive dampers so that the vibration of the vehicle body B can be suppressed by a damping force generated thereby.

Moreover, the root mean square of the speed deviation $\epsilon$ is calculated, and when the root mean square exceeds the predetermined speed threshold Vb, the travel position of the railcar is determined to be in a tunnel section, whereas when the root mean square is equal to or smaller than the speed threshold Vb, the travel position of the railcar is determined to be in an open section. In this case, the railcar damping device 1 can determine the section type of the current travel section of the railcar more accurately. Hence, frequently varying determinations of the section type are prevented, and as a result, a more appropriate control gain for the vibration mode of the vehicle body B can be selected, whereby the vibration of the vehicle body B can be suppressed with stability.

Furthermore, with the railcar damping device 1 according to this embodiment, when the travel position of the railcar is determined to be in a curved section, the control gain used to calculate the thrust $F\omega$ is reduced below the control gain used in a section of an open section other than a curved section. Therefore, the effect of steady-state acceleration that is difficult to remove using the band pass filters 42, 43 can be reduced, enabling a dramatic improvement in the passenger comfort of the railcar during travel in a curved section.

It should be noted that in the above embodiment, the plurality of actuators Af, Ar are controlled by the single controller C. This invention is not limited thereto, however, and one controller C may of course be provided for each of the actuators Af, Ar such that the respective actuators Af, Ar are controlled thereby.

Although the invention has been described above with reference to certain embodiments, the invention is not limited to the embodiments described above. Modifications and variations of the embodiments described above will occur to those skilled in the art, within the scope of the claims.

The contents of Tokugan 2011-136163, with a filing date of Jun. 20, 2011 in Japan, are hereby incorporated by reference.

The embodiments of this invention in which an exclusive property or privilege is claimed are defined as follows:

The invention claimed is:

1. A railcar damping device that determines a thrust to be output by an actuator as a thrust command value, and suppresses vibration of a vehicle body by controlling the actuator, wherein the actuator comprises:

a cylinder coupled to one of a truck and a vehicle body of a railcar;

a piston inserted into the cylinder to be free to slide;

a rod inserted into the cylinder and coupled to the piston and the other of the truck and the vehicle body; and a rod side chamber and a piston side chamber defined within the cylinder by the piston, wherein the railcar damping device comprises:

a tank that is configured to store a liquid that is supplied to and discharged from the cylinder;

a first opening/closing valve provided in a first passage connecting the rod side chamber to the piston side chamber to be capable of opening and closing the first passage;

a second opening/closing valve provided in a second passage connecting the piston side chamber to the tank to be capable of opening and closing the second passage;

a pump that is configured to supply the liquid from the tank to the rod side chamber;

a motor that is configured to rotate at a fixed rotation speed in order to drive the pump to rotate; and a section determination unit that is configured to determine whether a section type of a current travel section of the railcar is an open section or a tunnel section on the basis of a speed deviation between a target rotation speed and an actual rotation speed of the motor.

2. The railcar damping device as defined in claim 1, wherein, when the section type of the current travel section of the railcar is determined to be an open section and the thrust or the thrust command value of the actuator exceeds a thrust threshold, the section determination unit determines that the section type is a curved section.

3. The railcar damping device as defined in claim 1, wherein, when the section type of the current travel section of the railcar is determined to be a tunnel section and the thrust or the thrust command value of the actuator is equal to or smaller than a thrust threshold, the section determination unit determines that the actuator has failed.

4. The railcar damping device as defined in claim 3, wherein, when the section determination unit determines that the actuator has failed, the actuator is caused to function as a passive damper by switching the first opening/closing valve and the second opening/closing valve to a cutoff position and stopping the motor.

5. The railcar damping device as defined in claim 1, wherein the section determination unit calculates a root mean square of the speed deviation, and when the root mean square exceeds a predetermined speed threshold, the section determination unit determines that a travel position of the railcar is in a tunnel section, whereas when the root mean square is equal to or smaller than the speed threshold, the section determination unit determines that the travel position of the railcar is in an open section.

6. The railcar damping device as defined in claim 1, further comprising a command calculation unit that calculates a yaw command value for suppressing yaw vibration of the vehicle body from a yaw acceleration about a center of the vehicle body, calculates a sway command value for suppressing sway vibration of the vehicle body from a sway acceleration in a horizontal lateral direction of the vehicle body, and calculates the thrust command value from the yaw command value and the sway command value.

7. The railcar damping device as defined in claim 6, wherein, when the section determination unit determines a tunnel section, the command calculation unit sets a control gain used to calculate the yaw command value and the sway command value to be larger than a control gain used when an open section is determined.

8. The railcar damping device as defined in claim 6, wherein, when the section determination unit determines a curved section, the command calculation unit sets a control gain used to calculate the sway command value to be smaller than a control gain used when an open section but not a curved section is determined.

9. The railcar damping device as defined in claim 1, further comprising:

an exhaust passage connecting the rod side chamber to the tank; and a variable relief valve that is provided midway in the exhaust passage and has a modifiable valve opening pressure, wherein the thrust of the actuator is controlled by adjusting the valve opening pressure of the variable relief valve.

10. The railcar damping device as defined in claim 1, further comprising:

a suction passage that is configured to allow the liquid to flow only from the tank toward the piston side chamber; and a rectifying passage that is configured to allow the liquid to flow only from the piston side chamber toward the rod side chamber.

* * * * *